US009776238B1

(12) United States Patent
Zieve et al.

(10) Patent No.: US 9,776,238 B1
(45) Date of Patent: Oct. 3, 2017

(54) MAGNETIC SAFETY BASE FOR A LOWER PORTION OF A RIVETING TOOL

(71) Applicant: ELECTROIMPACT, INC, Mukilteo, WA (US)

(72) Inventors: Peter B. Zieve, Seattle, WA (US); Hunter P. O'Folan, Everett, WA (US)

(73) Assignee: Electroimpact, Inc., Mukilteo, WA (US)

( * ) Notice: Subject to any disclaimer, the term of this patent is extended or adjusted under 35 U.S.C. 154(b) by 0 days.

(21) Appl. No.: 15/191,839

(22) Filed: Jun. 24, 2016

(51) Int. Cl.

| | |
|---|---|
| ***B25C 5/02*** | (2006.01) |
| ***B21J 15/30*** | (2006.01) |
| ***H01F 7/06*** | (2006.01) |
| ***H01F 7/20*** | (2006.01) |

(52) U.S. Cl.
CPC ..... *B21J 15/30* (2013.01); *H01F 7/064* (2013.01); *H01F 7/206* (2013.01)

(58) Field of Classification Search
CPC . B21J 15/30; B21J 15/32; H01F 7/064; H01F 7/206
USPC ..... 227/113, 107, 112, 119, 51; 248/542
See application file for complete search history.

(56) References Cited

U.S. PATENT DOCUMENTS

| | | | | |
|---|---|---|---|---|
| 6,253,448 | B1 * | 7/2001 | Zieve | B21J 15/32 227/119 |
| 2009/0127279 | A1 * | 5/2009 | Zieve | B21J 15/32 221/267 |

* cited by examiner

*Primary Examiner* — Todd M Epps
(74) *Attorney, Agent, or Firm* — Clark A. Puntigam; Jensen & Puntigam, P.S.

(57) ABSTRACT

The magnetic base assembly includes an electromagnet assembly with a top surface open magnetic pole. A shunt plate is magnetically held to the top of the electromagnet. A canting or tilting of the shunt plate results when accidental side or pulling away contact is made between a riveting processing tool and an extending portion of the aircraft part being riveted as the tool is moved from one riveting location to another. The canting or pull off of the tool prevents damage. The operator can observe the tool canting and stop the tool movement or a micro switch or proximity switch senses the canting or tilting automatically so that the tool can be stopped before damage occurs. The magnetic field can be dynamically controlled to provide adequate pulldown force for the riveting function but a breakaway force less than the amount which would cause damage.

28 Claims, 8 Drawing Sheets

MAGNETIC SAFETY BASE FOR A LOWER PORTION OF A RIVETING TOOL

TECHNICAL FIELD

This invention relates generally to riveting machines for fabrication of aircraft and more specifically concerns a mechanism for preventing damage to aircraft parts and/or a lower riveting tool during the movement of the lower tool between successive riveting positions.

BACKGROUND OF THE INVENTION

A riveting machine for aircraft fabrication fastens together two aircraft parts or elements in which the plane of interface is perpendicular to the machine axis, usually horizontal. The interface plane could also be vertical. Fastening is carried out by first clamping the elements, followed by drilling a hole through the elements and then inserting a fastener. In a C or rectangular frame riveting machine upper and lower head assemblies are positioned in alignment on opposite sides of the work pieces and remain along the same vertical axis.

After drilling, inserting the rivet and fastening the rivet, with desired axial contact, referred to generally as installing the rivet, the opposing head assemblies will back away and the machine will move sideways to the next fastening location, under manual, semi-automatic or automatic CNC control. While the movement of the upper fastening head is relatively uncomplicated because the outer surface of outer part is smooth, or has fewer elements than the inner part, which is often complicated, with stringers, clips and frames which the lower tool can accidentally contact from the side and cause damage to during the sideways movement, as well as damaging the lower tool itself. This occurs if the movement of the tool does not avoid hitting the inner part elements. An additional issue occurs with a hooked or offset inner part structure. The backing away and movement of the lower tool is complicated and often results in undesirable contact. It would hence be desirable to have a system for attaching the lower head assembly so as to prevent damage to both the aircraft element parts and/or the tool itself. It would also be desirable to have a simplified changing system for the lower riveting tool.

SUMMARY OF THE INVENTION

Accordingly the magnetic base assembly comprises: an electromagnet assembly adapted to be supported on a lower ram assembly, the electromagnet assembly having a top surface defining an open magnetic circuit; and a plate of magnetically permeable material closing the magnetic circuit, held in place by magnetic force, wherein the riveting tool is attached to or extends toward the work piece from the opposite surface of the plate and wherein the magnetic force is selected or controlled such that the plate cants or tilts, or is pulled axially away, as a result of contact between the tool and an aircraft part as the tool moves from one operating position to another position, before damage occurs to the tool or the part.

BEST MODE FOR CARRYING OUT THE INVENTION

Figure 1:
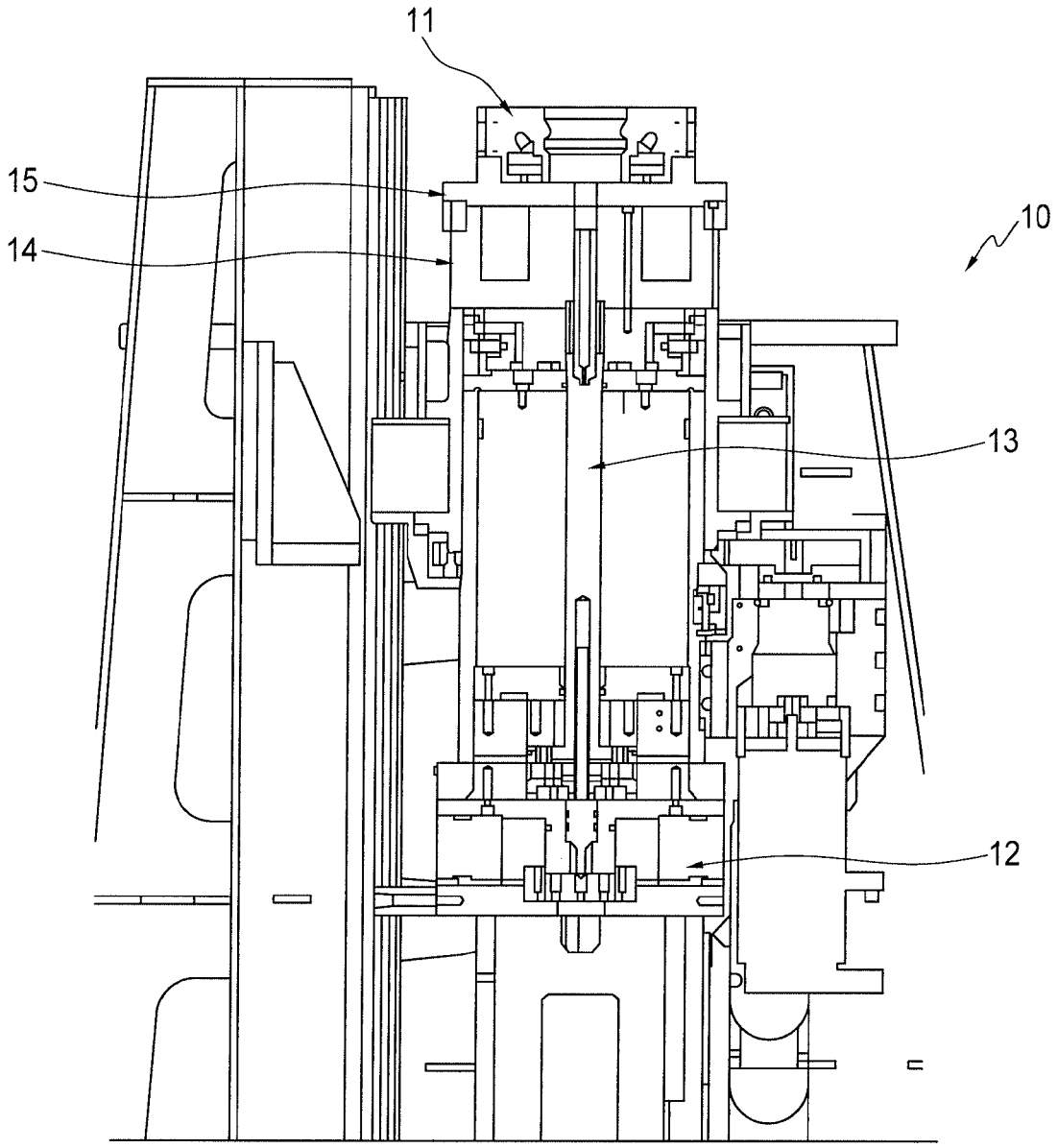
FIG. 1 is a detailed cross-sectional view of a lower head assembly portion of a riveting machine.

FIG. 1 shows a diagram of a lower head portion 10 of a riveting machine, positionable on one side of two aircraft parts to be riveted, opposite the drill side and the fastener head side. On the other side of the two aircraft parts is an upper head portion. Briefly in operation, the opposing upper and lower head portions are positioned in alignment, with the aircraft parts, i.e. the workpiece, in between. The opposing head portions put pressure on opposite sides of the workpiece to clamp the workpiece. This is done by clamping cylinder 12 and piston rod 13 in FIG. 1. The clamping pressure holds the two parts together, typically between 100 and 2000 pounds. When the parts are clamped, a drill is passed along a central axis from the upper head portion. The fastener is then inserted from the upper side of the parts into the drilled hole, and tools are then moved to finish and permanently install the fastener. Included at the upper surface of the lower head portion of one embodiment shown is a tool holding interface 11 which holds a lower processing tool, shown in FIGS. 2 and 3, for example. Other embodiments are described hereinafter. The lower processing tool typically extends upwardly for a distance of 300 mm, although this will vary depending on the application. The lower tool can be changed out frequently, depending on the characteristics of the aircraft as well as the fastener style and dimensions. This change out can include the magnetic shunt plate when a separate interface member is not used. The lower tool is typically driven up and down, toward and away from the parts being riveted, by a servomotor driving a lead screw (not shown).

Figure 2:
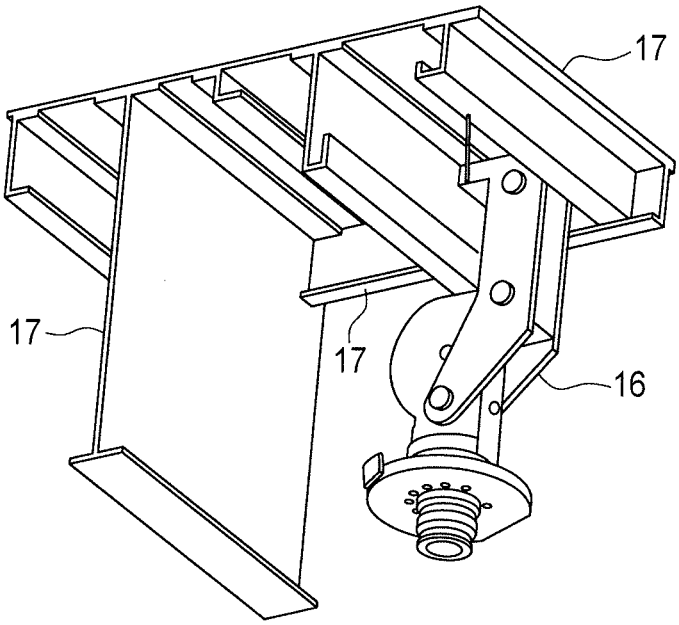
FIG. 2 is an isometric view of a lower riveting tool and one example of an inner surface of an aircraft part being riveted.
Figure 3:
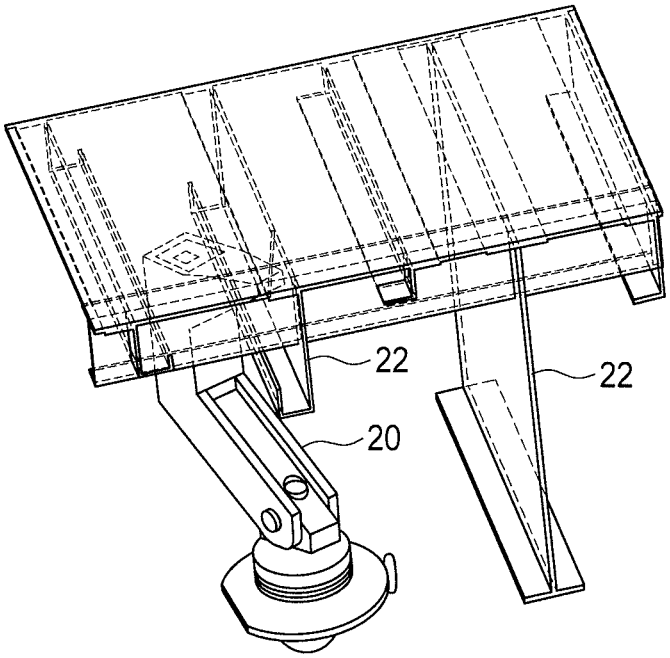
FIG. 3 is an isometric view of a lower riveting tool and an example of in inner surface structure with potential for undesired contact from downward movement of the tool.

As discussed above, when one fastening operation is completed, the tools are withdrawn and the assembly is moved automatically, in programmed function, by a CNC machine to the next riveting location. It can also be moved by manual or semi-automatic joystick control. For many arrangements, the upper tool can be easily and smoothly moved, since there are fewer (or no) obstructions on the outer side of the upper part. The lower tool, however, will have to avoid sideways contact with various elements on the internal side of lower part, such as ribs, stringers, etc. FIG. 2 shows an isometric view of a lower tool 16 and an inner part surface with various elements 17-17. These elements could include stringers, clips, frames and spars and other elements. FIG. 3 is a view showing another internal arrangement where the lower tool 20 needs to have a hooked or offset end which compliments hooked aircraft internal structures 22-22.

The present invention is a magnetic assembly which includes an electromagnet 14 and a top/shunt plate 15 shown in FIG. 1 designed to prevent damage due to accidental contact between the lower tool and inner part aircraft elements. When accidental sideways contact occurs, damage occurs. The assembly is shown in a detailed exploded view in FIG. 4. The assembly, shown generally at 26, includes a base element 28. The base element 28 is positioned on and connected to the lower head assembly (FIG. 1). The base assembly 28 is made from steel and in the embodiment shown is approximately 230 mm in diameter. The base assembly is approximately 80 mm high and includes a circular open area 30. Positioned around the inner surface 31 of the magnetic base is a magnetic contact ring portion 32, flush with the inner surface of the magnetic base. In the center of the open area 30 is a cylindrical steel section 36, approximately 91 mm in diameter, defining a ring-shaped open area with an outer diameter of approximately 168 mm, and a depth of 52 mm. These dimensions can vary. Positioned in this open area is a coil 38. In the embodiment shown, coil 38 has approximately 2500 turns of wire, with a potting compound sufficient to fill the open area 30. The resulting electromagnet is capable of a holding force from 100 pounds at low power to as much as 3500 pounds of force at high power with a continuous duty cycle of electric power.

Positioned on magnetic base is a crown ring 40. The crown ring 40 has an outside diameter approximately the same as magnetic base 28 with an inner surface adjacent the extending portion of ring 32, creating a counter bore 33 (FIG. 5) which centers the lower tool. In the embodiment shown, the upper surface 42 of the crown ring 40 extends 3 mm above the upper surface of ring portion 32, creating counter bore 33 for the shunt plate (described below) boss 35 to fit snugly for precise centering of the shunt plate. In the embodiment shown in FIG. 4, crown ring 40 includes three recesses 44-44 which are configured to receive spaced micro switches 46-46. While the embodiment shown includes three equally spaced micro switches, the system could operate with a single micro switch, or there could be additional micro switches, which could also be used to determine whether the lower tool is canted. There could also be no switches, in which case the operator could observe that the lower tool has tilted or canted or been knocked off the lower ram and stop the motion of the tool.

Figure 6:
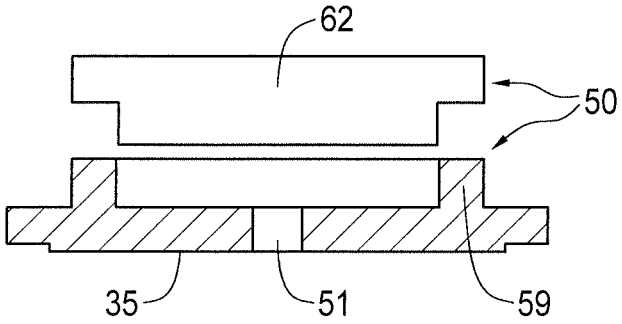
FIG. 6 is a simplified cross-sectional view of the top shunt plate portion of the magnetic base assembly of FIG. 4.
Figure 6A:
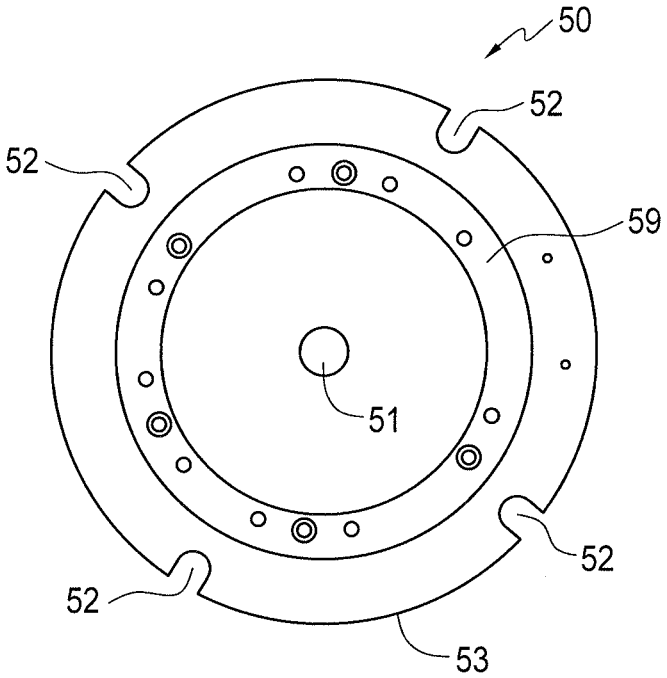
FIG. 6A is a top plan view of the part shown in FIG. 6.

Positioned on the crown ring is an electromagnet shunt plate 50. Shunt plate 50 is circular and has a diameter similar to the diameter of the crown ring 40, located directly beneath it. Shunt plate 50 is made of steel and has a central opening 51 to permit the lower head clamp cylinder to operate/extend therethrough in the embodiment shown In one embodiment, the shunt plate 50 is circular and has a diameter similar to the diameter of the crown ring 40, located directly beneath it. Shunt plate 50 is made of steel and has a central opening 51 to permit the lower head clamp cylinder to operate/extend therethrough in the embodiment shown. The shunt plate has four equally spaced cut out portions 52-52 extending inwardly from the rim 53 thereof. Four bolts 54-54 are positioned in these cut out portions and are threaded into the crown ring 40 in the embodiment of FIG. 4. The four bolts extend above the surface of the shunt plate and simply provide a restraint to maintain the shunt plate from falling off the assembly during operation. The shunt plate is not removed. Other embodiments described below do not include the cutout portions and the restraining bolts. The shunt plate 50 has a lower boss portion 35 (FIG. 6) with a 190 mm diameter for base tool centering. This fits snugly in a 3 mm counter bore 33 in the magnetic base/crown ring. This keeps the tool centered. A long tool can thus be effectively stabilized. When the tool rotates a small amount (10 degrees) the boss clears the center base to further reduce any damage. In the embodiment described above, the shunt plate is a permanent part of the machine; it does not change out with the lower riveting tool. The shunt plate also has a clocking pin 63 which extends into the crown ring, for locating purposes. Extending upwardly from the upper surface 60 of shunt plate 50 is a ring portion 59 in the embodiment of FIG. 4, to which a tool clamp 62 (FIG. 4) is attached. The tool clamp 62 is a conventional element which supports a lower processing tool assembly (not shown), and permits lower processing tool assemblies to be interchanged depending on the application. The shunt plate in the FIG. 4 embodiment is not part of the lower tool.

In operation, as the lower processing tool is moved laterally under control of a CNC unit, and contacts an aircraft part, the shunt plate 50, which is held in place by magnetic force, will cant or tip a small amount, typically in the range of 10-15 degrees. This would be recognized by one or more of the switches 46, which could be micro switches or proximity switches, for example, which would send a signal to the CNC to terminate movement of the lower processing tool, fast enough to prevent damage to the part or the tool, although contact could be made (without damage). In another arrangement, an operator could observe the canted position of the lower tool and stop the movement of the tool. At this point, an operator can take over control of the tool movement to avoid damaging contact with the part. Once the tool is released or backed off from contact, shunt plate 50 will return to its normal seated position against the crown ring 40.

Figure 7:
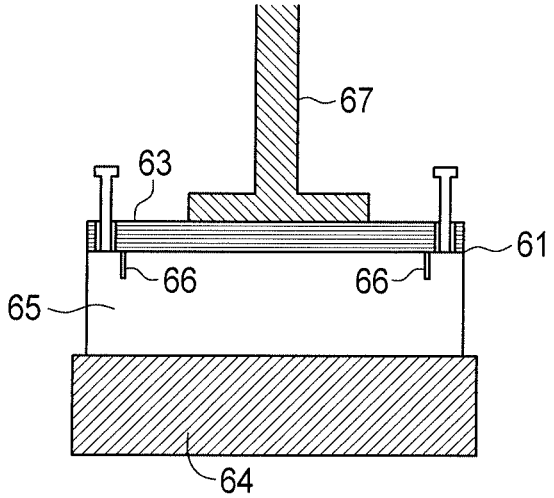
FIG. 7 is a simplified cross section view of the system showing the position of the shunt plate of FIG. 6 when it is seated, with a tool clamp unit above the shunt plate.
Figure 8:
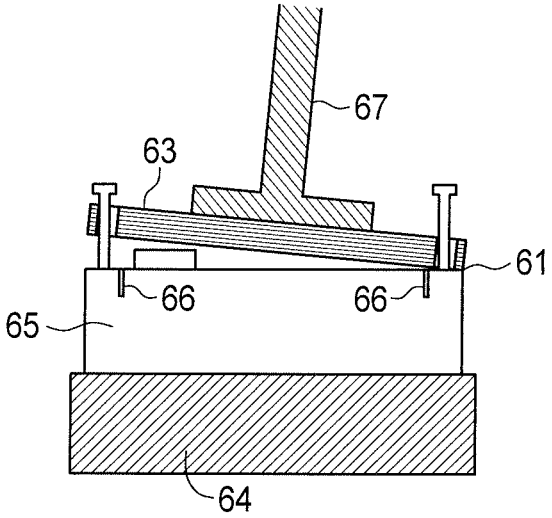
FIG. 8 is a simplified cross-sectional view showing the position of the shunt plate when the tool encounters a part in sideways movement and is canted.

This action is shown in simplified form in FIGS. 7 and 8. The magnet assembly is positioned between the lower ram 64 and the lower riveting tool 67. When the interface 61 between the shunt plate 63 and the electromagnet 65 (the crown ring), is in its closed or seated position, in FIG. 7, the shunt plate 63 fits down firmly on the crown ring, held there by magnetic force of pre-selected magnitude, and the micro switches or proximity switches 66 are in their closed positions. FIG. 8 shows a similar view with the processing tool 61 and the shunt plate 63 canted. The contact overpowers the magnetic force of the electromagnet and causes the shunt plate 50 to rotate or cant, tripping one or more of the switches on the perimeter of the crown ring at the locations shown.

The ability to adjust the force (100-3500 pounds) in the present system is critical to the invention. This is explained in more detail below. The amount of magnetic force can be controlled by varying the voltage under CNC control applied to the electromagnet terminals.

In one example, a magnet base is 230 mm in diameter. If the riveting tool is 300 mm long along the riveting axis and makes contact with the aircraft part and if 300 lbs of magnet force is applied, 115 pounds of force at the tip of the tool will cause a shunt plate 50 to unseat, i.e., cant or rotate and trip switches positioned in the crown ring 40. The 300 pounds of force is a typical amount of force for riveting (10 vdc). The adjustability of this force has many advantages.

Turning off the voltage source (to 0V) to the electromagnet causes a reduction in electromagnetic force (not zero due to magnetic remanence), but is still low enough to permit convenient changing of the lower process tool when the magnetic shunt plate is part of the lower tool. A small alternating voltage +/−5 VDC applied to the electromagnetic coil winding will demagnetize the base and bring the magnetic force to zero. This is convenient in building, handling and changing out of the shunt plate. Once the next lower riveting tool is positioned, the magnetic force is increased to the appropriate level for operation.

The 300 pounds of magnetic pulldown is too much for the offset part arrangement of FIG. 2. If the riveting tool has a hook shape and in fact is actually hooked over an aircraft part and the tool is pulled down, 300 pounds of force might damage the part. In such a case, the magnetic force is reduced to 100 lbs (5V) during the downward motion of the tool. When the lower ram drops down, only 100 pounds of magnetic force is applied to the aircraft part and then the shunt plate easily unseats from the magnet base, preventing damage to the part. However, 300 pounds of force is not enough for a collar swaging function. After the collar is swaged onto the pin, a maximum of 2500 pounds of pulldown force is necessary to strip the swage die off of the swaged collar. To allow for this action, the electromagnet is designed to provide 3500 pounds of pulldown force. 3500 pounds of force is achieved with 90 VDC. Therefore the same base assembly can be used for all riveter functions. If an extremely long and heavy lower riveting tool is used, then 300 lbs of magnet force is not sufficient and 500 lbs of force (20 VDC) would likely be used.

Another advantage of this invention is decreasing the effort of changing the lower riveting tool. The magnetic force can be reduced to a low or zero level so that the previous tool can be removed by simply lifting it away and dropping the new one down on the base member. The magnetic force can then be increased to an ideal level for use of the lower riveting tool. No tools are required. No clamps need to be released or reengaged. If the magnetic force was set at 300 pounds it would be very difficult to remove the lower riveting tool. At 100 pounds, the tool can be manually rotated. If the magnetic force was set at 300 pounds or more it would be dangerous for the operator to place the replacement tool on the base member, risking injury to fingers or arm, due to the high force. At 100 pounds or less the removal and replacement of the tool by a technician can be done easily and safely.

The user can vary the voltage and therefore the pulldown force, depending on the motion direction, or depending on the experience of the user, as desired. The variable capability (adjustability) of the force has an important advantage to the system designer, who may design the riveting system without a specific force value. Depending on the particular application, the designer can set the correct force for the application when the use for the machine is determined. The force could be set high for swaging, low for riveting and any particular value in between.

If permanent magnets were used instead of the present electromagnet, the adjustment would be difficult and could likely require a factory technician.

Figure 9:
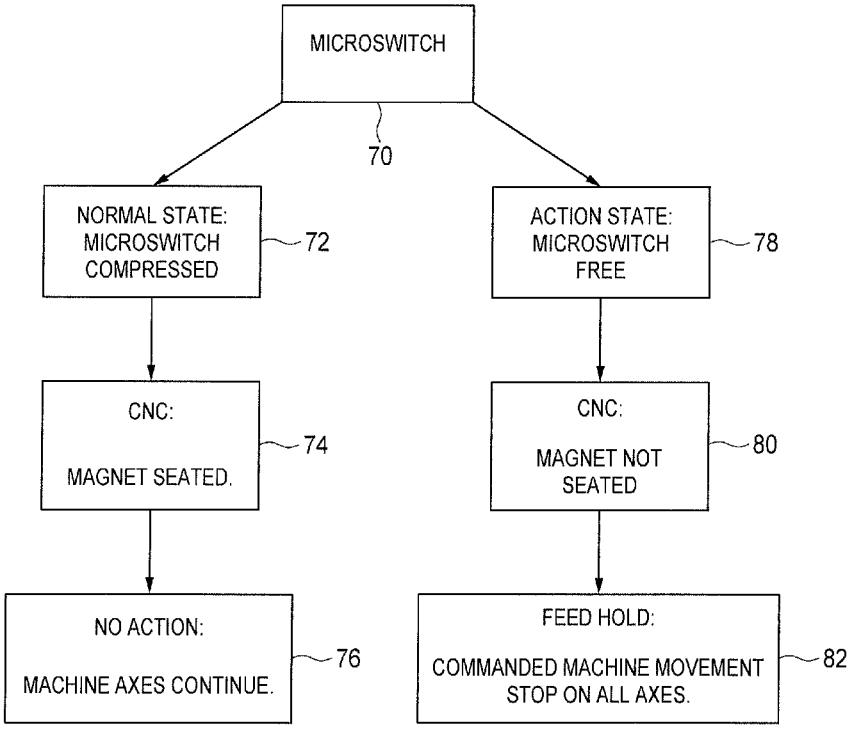
FIG. 9 is a block diagram of the control portion of the system.

FIG. 9 shows the control for the system. The micro switch or proximity switch 70 in its normal state is compressed or closed as shown at 72, with the magnetic shunt plate seated, at 74. Each switch is continually monitored by the CNC. If the switch is compressed, indicating a normal status, the assembly keeps moving, as represented at 76. However, if one or more switches is found to be open or free as shown at 78, indicating that the magnetic shunt plate is canted, i.e. not seated, at 80, indicating that contact has been made between the tool and a part, a signal is sent to the CNC, which in turn stops the motion of the tool along every axis, shown at 82. An operator will then assume control of the movement of the tool assembly, using a camera on the tool assembly to move the tool away from the contact and then to its next position without striking any portions of the part.

Figure 10:
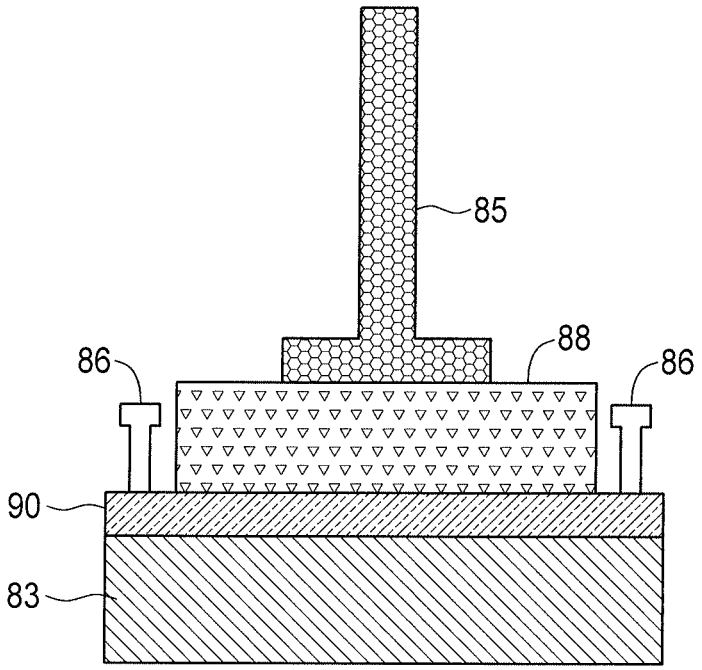
FIG. 10 is a simplified cross-sectional diagram of another embodiment of the present invention.
Figure 11:
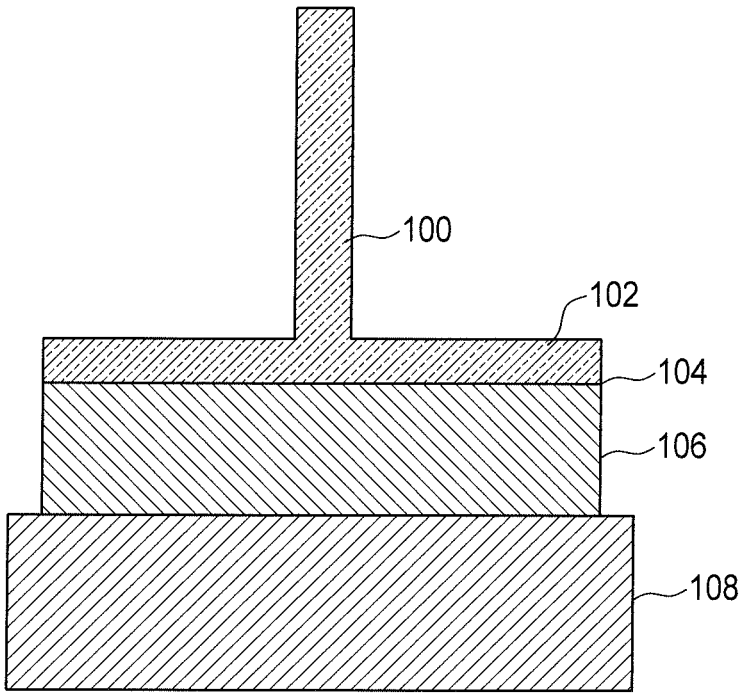
FIG. 11 is a simplified cross-sectional diagram of a further embodiment of the present invention.

FIGS. 10 and 11 show different embodiments of the arrangement of FIG. 7 and. In these figures the switches are not shown for purposes of clarity. They can use micro switches or proximity switches for detection of separation of the shunt plate from the electromagnet 83 (in particular the crown ring) at the separation plane 85, or the operator can observe the tool canting. The unit includes two shoulder bolts 86-86, also shown in FIGS. 7 and 8, which tend to maintain the shunt plate on the assembly. FIG. 10 shows a specific arrangement which includes a tool clamp module 68 where the processing tool 82 is mechanically clamped to the module 68, which is attached to the shunt plate 90. This arrangement permits changing the lower riveting tool without removing the shunt plate. The separation interface 85 is located between shunt plate 90 and the electromagnet 83.

Figure 4:
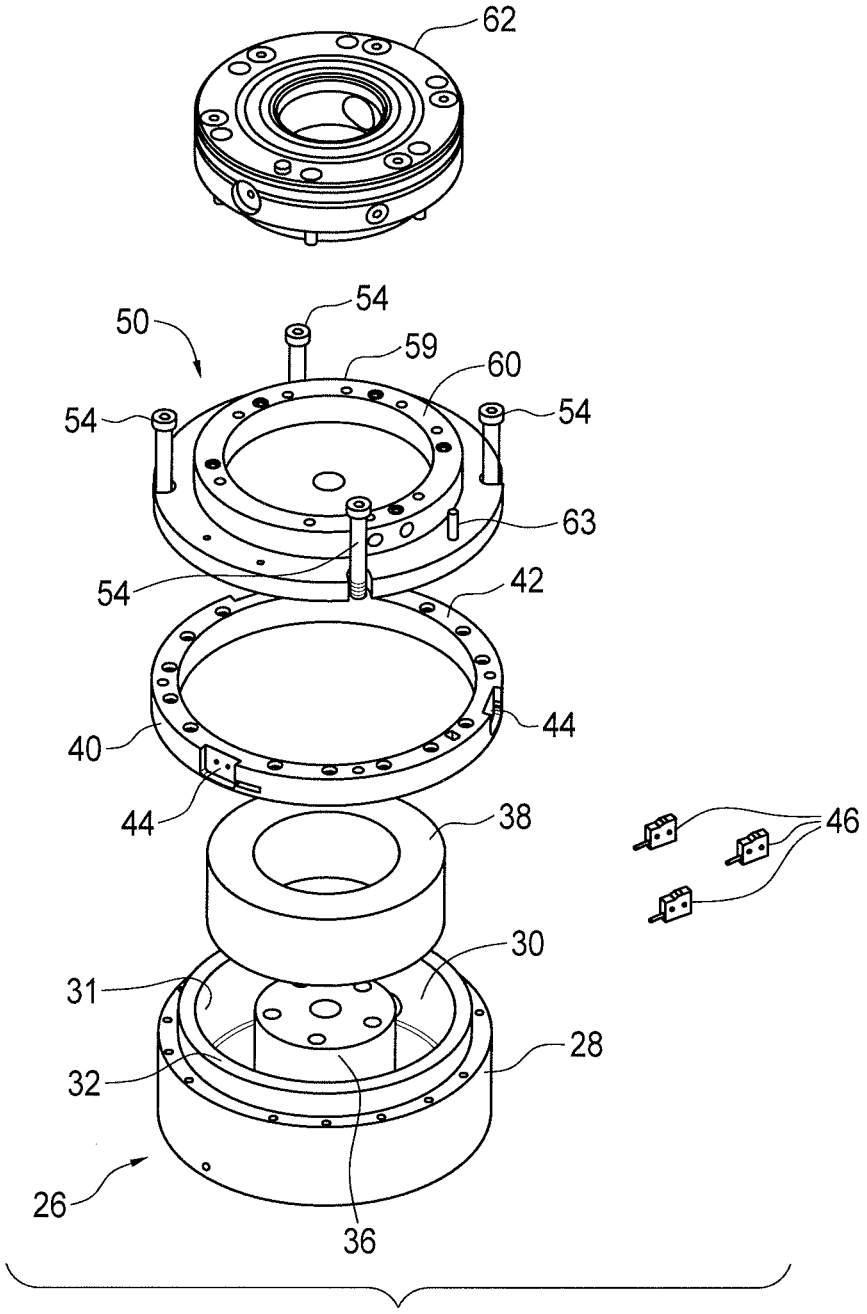
FIG. 4 is an exploded view of the magnetic base assembly of one particular embodiment of the present invention.
Figure 5:
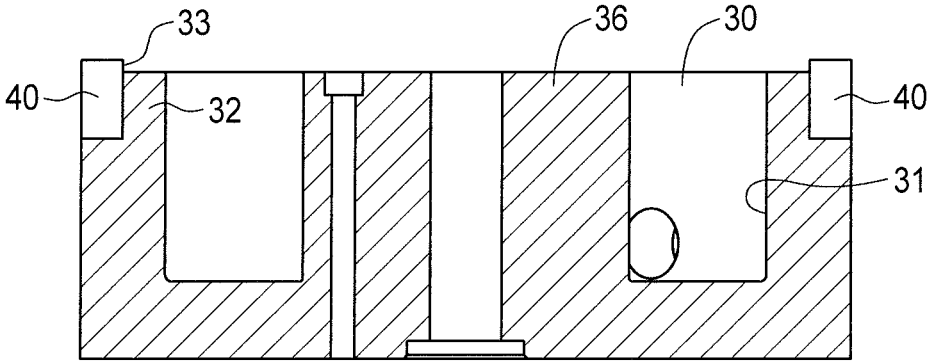
FIG. 5 is a cross-sectional view of one part of the one embodiment of the magnetic base assembly.
Figure 5A:
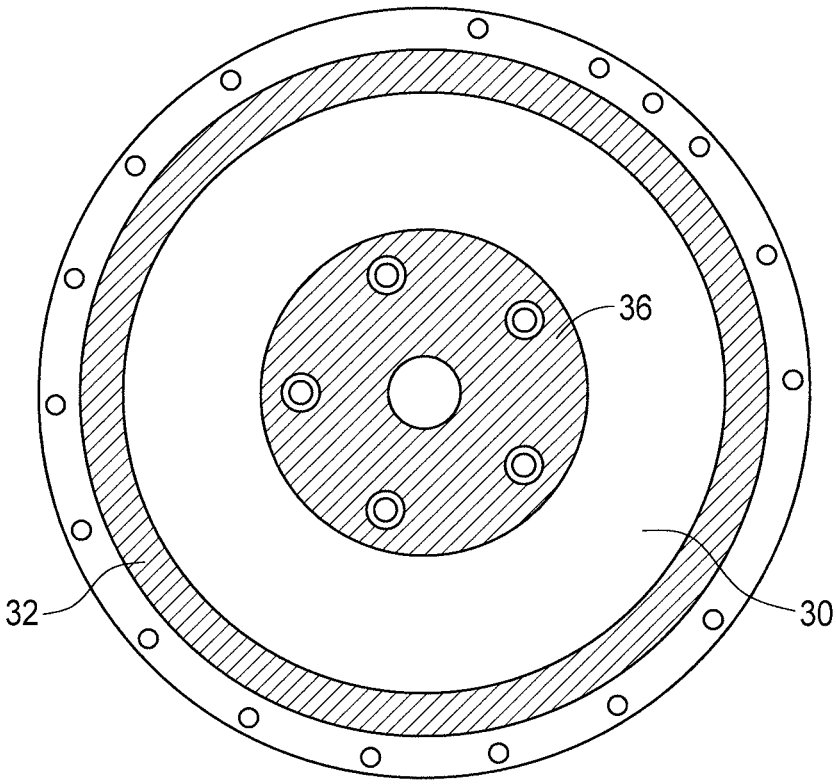
FIG. 5A is a top plan view of the part of FIG. 5.

FIG. 11 shows another important embodiment in which the lower processing tool 100 and the shunt plate 102 are integral. This is a different arrangement than is shown in FIG. 4 which is described in detail above. The separation plane 104 is between the lower surface of the shunt plate 102 and electromagnet 106 which is positioned on the lower processing head 108. This embodiment does not include any shoulder bolts. This arrangement has the benefit that the voltage can be brought to zero and the tool can be easily and conveniently changed.

Accordingly, a system has been described using magnetic action and micro switches or proximity switches to recognize contact between a lower process tool for riveting and an aircraft part as the tool is moved under CNC control to a riveting position. Contact of the tool with the part results in release of at least one switch and canting of the shunt plate, which is monitored by the CNC. When a release is recognized, the CNC terminates movement of the process tool, typically before damage to the part occurs. An operator is then free to move the tool to its next operating position. Alternatively, the operator can observe the canting/tilting of the tool and stop further movement before damage occurs to the aircraft part or the tool.

Although a preferred embodiment of the invention has been disclosed here for purposes of illustration, it should be understood that various changes, modifications and substitutions may be incorporated in the embodiment without departing from the spirit of the invention which is defined by the claims which follow:

What is claimed is:

1. A magnetic base assembly for preventing damage caused by movement of a lower riveting tool in aircraft assembly operations, comprising:

an electromagnet assembly adapted to be supported on a lower ram assembly, the electromagnet assembly having a top surface defining an open magnetic circuit; and a plate of magnetically permeable material closing the magnetic circuit, held in place by magnetic force, wherein the riveting tool is attached to or extends toward a work piece from an opposite surface of the plate and wherein the magnetic force is selected or controlled such that the plate cants or tilts or is pulled axially away, as a result of contact between the tool and an aircraft part as the tool moves from one operating position to another position, before damage occurs to the tool or the part.

2. The assembly of claim 1, wherein the cant or tilt of the plate is recognizable by an operator before the damage occurs.

3. The assembly of claim 1, including an adjustable power supply for the electromagnet to vary the magnetic force holding the plate in place.

4. The assembly of claim 1, wherein the plate is steel and acts as a shunt plate.

5. The assembly of claim 4, wherein the steel shunt plate is part of the riveting tool.

6. The assembly of claim 4, wherein as the lower ram assembly drops down in operation, and contact occurs, the steel plate and the riveting tool attached thereto are pulled axially away from the electromagnet assembly, which is observable by an operator.

7. The assembly of claim 1, wherein the assembly is rotatable.

8. The assembly of claim 1, wherein the riveting tool is attached to the plate with bolts.

9. The assembly of claim 1, wherein the riveting tool is attached to the plate by a pneumatically actuated clamp.

10. The assembly of claim 1, wherein when downward movement of the tool is obstructed by the tool being hooked over the aircraft part, and contact occurs, the plate and the riveting tool unseat or pull away from a base member before damage occurs.

11. The assembly of claim 1, wherein the lower riveting tool and the plate are integral.

12. The assembly of claim 1, wherein the magnetic force holding the plate in a seated position is adjustable by a controlling voltage applied to a coil portion of the electromagnet assembly.

13. The assembly of claim 1, including a clocking pin on the plate to maintain alignment of the plate and the electromagnet.

14. The assembly of claim 1, including a mechanical interface module mounted on an upper surface of the plate, to permit a plurality of riveting tools to be used with the same plate.

15. The assembly of claim 1, wherein the plate is also held in place by a mechanical fit between a lower surface of the plate and an upper edge of the electromagnetic assembly.

16. The assembly of claim 1, wherein the contact is sideways or upward.

17. The assembly of claim 1, wherein the electromagnet assembly includes a coil with approximately 2500 turns of wire to provide a retention force in a range of 100-3500 lbs., depending on a voltage provided to the coil.

18. The assembly of claim 17, including an adjustable power supply to vary the retention force.

19. The assembly of claim 17, wherein the retention force can be reduced to zero to enable convenient change of the riveting tool.

20. The assembly of claim 19, wherein the riveting tool can be changed without assembly tools or release latches and where the retention force can be increased following positioning of the new tool to a force appropriate for riveting.

21. The assembly of claim 1, including at least one switch positioned in the electromagnet assembly to recognize the cant or tilt of the plate.

22. The assembly of claim 21, including a signal link from the switch to a system controller which acts in response to prevent further movement of the tool.

23. The assembly of claim 22, wherein as the lower ram assembly drops down in operation and contact occurs, the steel plate and the riveting tool attached thereto are pulled axially away from the electromagnet assembly which is recognized by the switch, which signals the controller to prevent further movement of the tool.

24. The assembly of claim 21, wherein the electromagnetic assembly includes a base member with an open center area for receiving a winding, and a crown ring positioned around an upper periphery of the base member and wherein said at least one switch includes more than one switch, positioned in the crown ring.

25. The assembly of claim 24, wherein the switches are micro switches or proximity switches.

26. The assembly of claim 24, including at least three spaced switches in the crown ring.

27. The assembly of claim 24, wherein the switches are closed or seated until the riveting tool makes accidental sideways contact with the part, at which point the shunt plate cants or tilts and the switches open.

28. The assembly of claim 24, including a plurality of upstanding shoulder bolts extending upwardly from the crown ring, wherein the bolts are positioned in cut out portions of the shunt plate for preventing the shunt plate coming off of the electromagnet.

* * * * *